US006510761B2

(12) United States Patent
Zhang et al.

(10) Patent No.: US 6,510,761 B2
(45) Date of Patent: Jan. 28, 2003

(54) CONTROL SYSTEM FOR ADJUSTABLE PEDAL ASSEMBLY

(75) Inventors: Rongjun Zhang, Rochester, MI (US); Steven Allen Toelke, Royal Oak, MI (US); Gordon Lloyd Smith, Orion, MI (US); Richard Scott Bigham, Kalkaska, MI (US); Michael William DePotter, Berkley, MI (US)

(73) Assignee: Dura Global Technologies, Rochester Hills, MI (US)

( * ) Notice: Subject to any disclaimer, the term of this patent is extended or adjusted under 35 U.S.C. 154(b) by 0 days.

(21) Appl. No.: 10/026,500

(22) Filed: Dec. 19, 2001

(65) Prior Publication Data

US 2002/0078786 A1 Jun. 27, 2002

Related U.S. Application Data

(62) Division of application No. 09/492,636, filed on Jan. 27, 2000, now Pat. No. 6,352,007.

(51) Int. Cl.[7] ..... G05G 1/14

(52) U.S. Cl. ..... 74/512

(58) Field of Search ..... 74/512, 513, 514, 74/560, 473.17; 280/261

(56) References Cited

U.S. PATENT DOCUMENTS 4,870,871 A * 10/1989 Ivan ..... 74/513

* cited by examiner

*Primary Examiner*—Chong H. Kim
(74) *Attorney, Agent, or Firm*—Casimir R Kiczek

(57) ABSTRACT

A method of operating a control pedal assembly includes the steps providing a pair of adjustable control pedals. Each control pedal includes a first support and a second support having a lower arm and moveable relative to the first support to adjust the fore-aft position of the lower arm upon operation of a motor. A predetermined fore-aft relationship is provided between the lower arms of each of the pair of control pedals. The predetermined fore-aft relationship is maintained during operation of the motor to move the second supports relative to the first supports while adjusting the fore-aft position of the lower arms. The motor is stopped during operation if the predetermined fore-aft relationship between the lower arms is not maintained.

23 Claims, 7 Drawing Sheets

FIG-5A
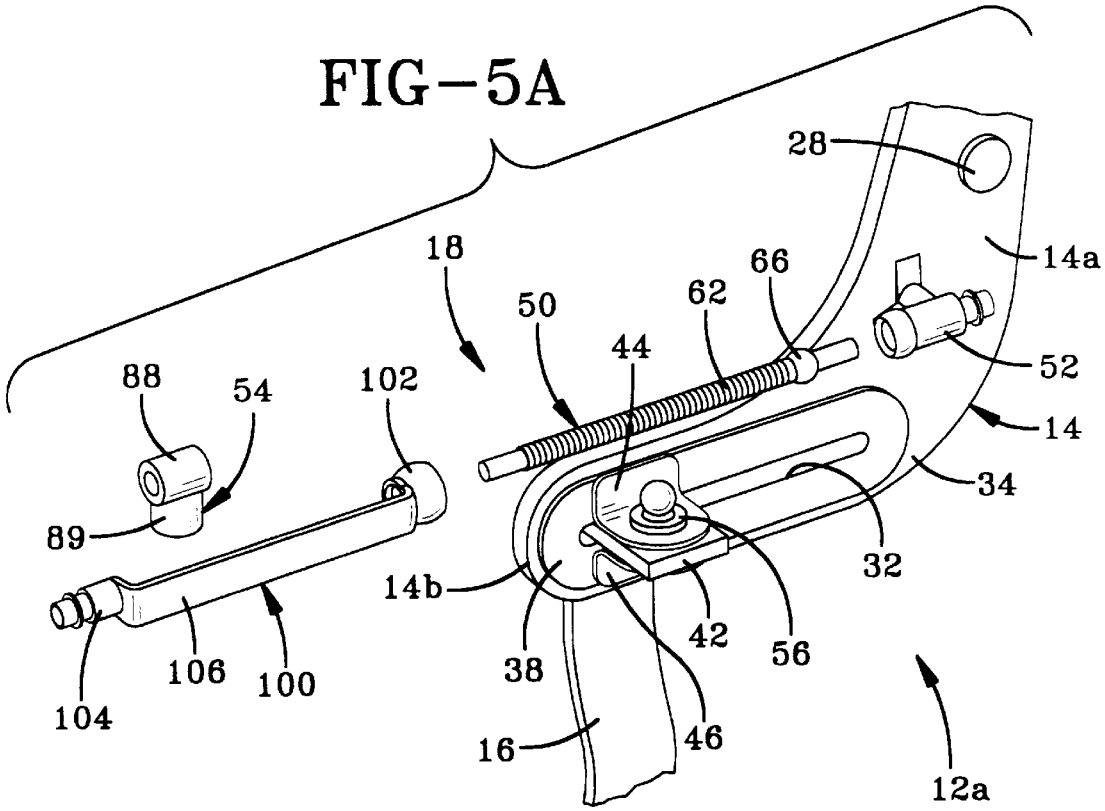
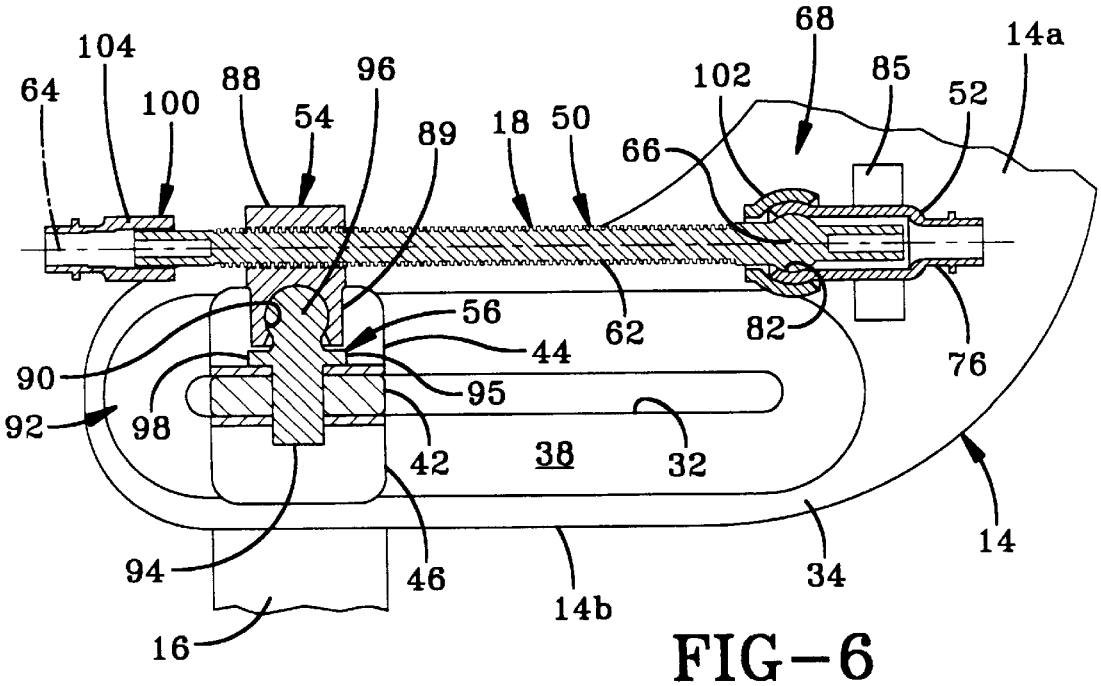
FIG-6

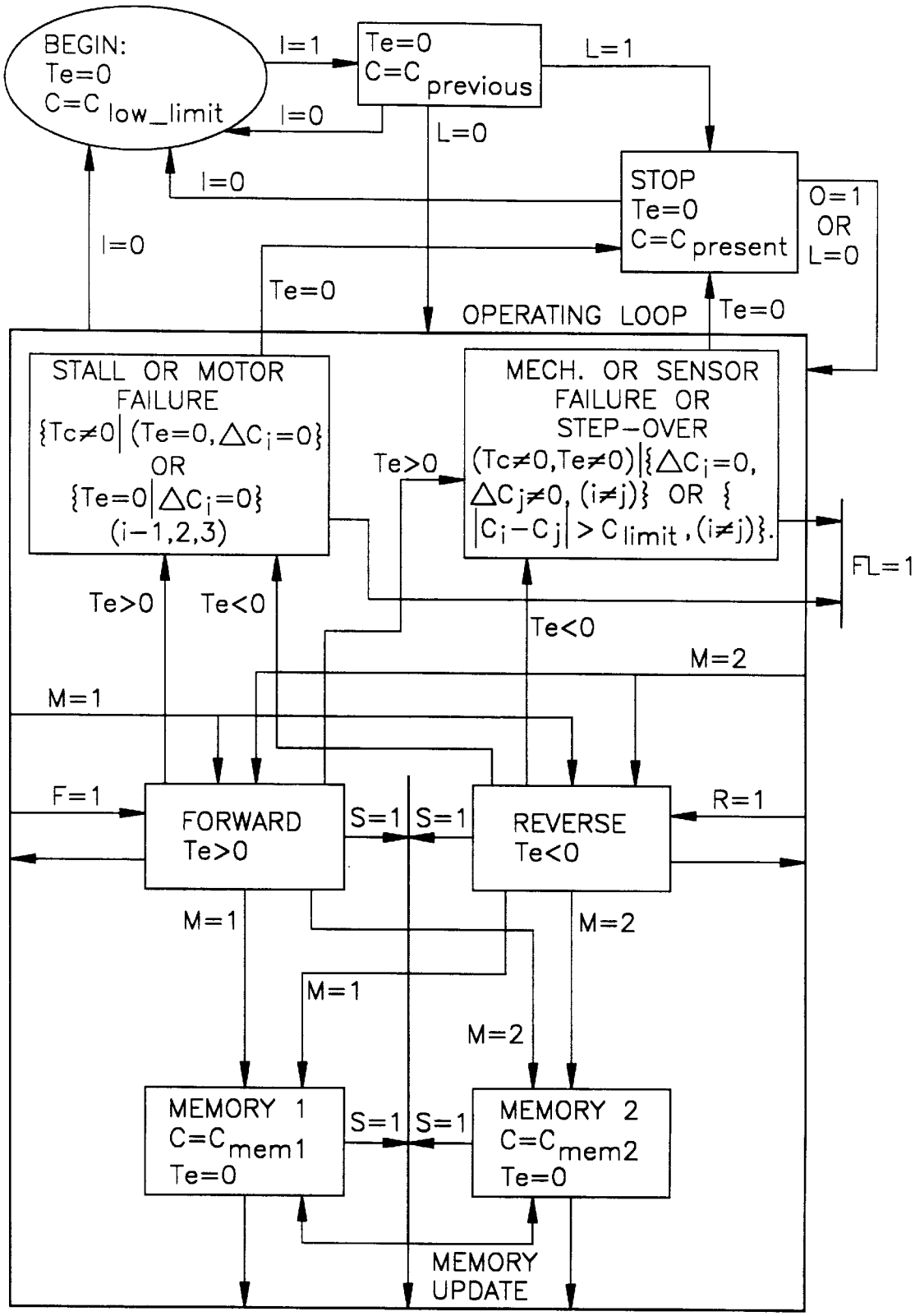
FIG−8

CONTROL SYSTEM FOR ADJUSTABLE PEDAL ASSEMBLY

CROSS-REFERENCE TO RELATED APPLICATIONS

This application is a divisional of patent application Ser. No. 09/492,636 filed Jan. 27, 2000, now U.S. Pat. No. 6,352,007.

STATEMENT REGARDING FEDERALLY SPONSORED RESEARCH

Not Applicable

REFERENCE TO MICROFICHE APPENDIX

Not Applicable

FIELD OF THE INVENTION

The present invention generally relates to a control pedal for a motor vehicle and, more particularly, to a control system for selectively adjusting the control pedal to desired positions.

BACKGROUND OF THE INVENTION

Control pedals are typically provided in a motor vehicle, such as an automobile, which are foot operated by the driver. Separate control pedals are provided for operating brakes and an engine throttle. When the motor vehicle has a manual transmission, a third control pedal is provided for operating a transmission clutch. A front seat of the motor vehicle is typically mounted on tracks so that the seat is forwardly and rearwardly adjustable along the tracks to a plurality of positions so that the driver can adjust the front seat to the most advantageous position for working the control pedals.

This adjustment method of moving the front seat along the tracks generally fills the need to accommodate drivers of various size, but it raises several concerns. First, this adjustment method still may not accommodate all drivers due to very wide differences in anatomical dimensions of drivers. Second, the position of the seat may be uncomfortable for some drivers. Therefore, it is desirable to have an additional or alternate adjustment method to accommodate drivers of various size.

Many proposals have been made to selectively adjust the position of the control pedals relative to the steering wheel and the front seat in order to accommodate drivers of various size. For example, U.S. Pat. Nos. 5,632,183, 5,697,260, 5,722,302, 5,819,593, 5,937,707, and 5,964,125, the disclosures of which are expressly incorporated herein in their entirety by reference, each disclose an adjustable control pedal assembly. The control pedal assembly includes a hollow guide tube, a rotatable screw shaft coaxially extending within the guide tube, a nut in threaded engagement with the screw shaft and slidable within the guide tube, and a control pedal rigidly connected to the nut. The control pedal is moved forward and rearward when an electric motor rotates the screw shaft to translate the nut along the screw shaft within the guide tube. A potentiometer is provided at the motor which sends signals to a CPU regarding motor shaft position for determining the position of the nut. While this control pedal assembly may adequately adjust the position of the control pedal to accommodate drivers of various size, this control pedal may be prone to undetected failures. Accordingly, there is a need in the art for an adjustable control pedal assembly which selectively adjusts the position of the pedal to accommodate drivers of various size, is relatively simple and inexpensive to produce, and is highly reliable in operation.

SUMMARY OF THE INVENTION

The present invention provides a control system for an adjustable control pedal which overcomes at least some of the above-noted problems of the related art. According to the present invention, a control pedal includes a first support, a screw secured to the first support, a nut threadably engaging the screw and adapted to move axially along the screw upon rotation of the screw, and a motor operatively connected to the screw to selectively rotate the screw. A second support carries a pedal at a lower end and is operatively connected to the nut for fore-aft movement of the second support relative to the first support upon axial movement of the nut along the screw. A control system includes a sensor located near the screw and adapted to sense rotations of the screw and a controller in communication with the sensor to receive signals from the sensor. With the sensor located near the screw, rotation of the screw can be directly determined from the sensor.

According to another aspect of the present invention, a control includes a first support, a screw secured to the first support, a nut threadably engaging the screw and adapted to move axially along the screw upon rotation of the screw, and a motor operatively connected to the screw to rotate the screw and axially move the nut along the screw in response to rotation of the screw. A second support carries a pedal and is operatively connected to the nut for fore-aft movement of the second support relative to the first support upon axial movement of the nut along the screw. The control pedal also includes a sensor and a controller in communication with the sensor to receive signals from the sensor. The controller is adapted to determine a position of the nut along the screw based on signals from the sensor and to automatically stop the motor when the nut reaches a predetermined end of travel for the nut along the screw. By utilizing electronic or "soft" stops rather than engaging mechanical or "hard" stops at the ends of travel, undesired stress on the motor and premature failure of the motor can be prevented.

According to yet another aspect of the present invention, a control pedal includes a first support, a screw secured to the first support, a nut threadably engaging the screw and adapted to move axially along the screw upon rotation of the screw, and a motor operatively connected to the screw to selectively rotate the screw and axially move the nut along the screw in response to the rotation of the screw. A second support carries a pedal and is operatively connected to the nut for fore-aft movement of the second support relative to the first support upon axial movement of the nut along the screw. The control pedal further includes a sensor and a controller in communication with the sensor to receive signals from the sensor. The controller is adapted to automatically stop the motor when signals from the sensor indicate that the screw is not rotating. An early detection of a failure in the mechanical system allows the pedal assembly to be "shut down" to prevent damage or further damage to the system.

According to even yet another aspect of the present invention, a control pedal assembly includes first and second control pedals Each control pedal includes a first support, a screw secured to the first support, and a nut threadably engaging the screw. Each control pedal also includes a second support carrying a pedal and operatively connected to the nut for fore-aft movement of the second support relative to the first support upon axial movement of the nut along of the screw. A control system includes at least one motor operatively connected to the screws to selectively rotate the screws and axially move the nuts along the screws in response to rotation of the screws, a sensor located near the screw of the first control pedal and adapted to sense rotation of the screw of the first control pedal, and a controller in communication with the sensor to receive signals from the sensor. In one embodiment the screws are connected in series with the motor and the sensor is located near the last screws so that a single sensor is required to indicate failure anywhere along the drive chain. In another embodiment, a second sensor is located at the screw of the second control pedal. This embodiment is particularly advantageous to automatically stop the motor when positions of the nuts indicate that a predetermined fore-aft relationship between the pedals has not been maintained. An example of such a predetermined fore-aft relationship is the rearward positioning of an accelerator pedal relative to a brake pedal which is typically referred to as step over. Early detection of a change in the predetermined relationship between the two control pedals allows the control pedal assembly to be "shut down" to minimize the change in the predetermined relationship between the control pedals.

According to even yet another aspect of the present invention, a control pedal includes a first support, a screw secured to the first support, a nut threadably engaging the screw and adapted to axially move along the screw upon rotation of the screw; and a motor operatively connected to the screw to selectively rotate the screw and axially move the nut along the screw. A second support carries a pedal and is operatively connected to the nut for fore-aft movement of the second support relative to the first support upon axial movement of the nut along the screw. A controller is in communication with the motor and is adapted to automatically operate the motor to move the second support in a forward direction relative to the first support to a predetermined position when predetermined conditions are met. By Automatically moving the control pedal forward when the predetermined conditions indicate the driver is about to egress the motor vehicle, the driver is provided additional leg room to egress the vehicle and the next driver has additional room to ingress the vehicle.

According to even yet another aspect of the present invention, a control pedal assembly includes a first support, a screw secured to the first support, a nut threadably engaging the screw and adapted to axially move along the screw upon rotation of the screw, and a motor operatively connected to the screw to selectively rotate the screw and axially move the nut along the screw. A second support carries a pedal and is operatively connected to the nut for fore-aft movement of the second support relative to the first support upon axial movement of the nut along the screw. A control system includes a lock-out switch adapted to be manually engaged and a controller which operatively connects the lock-out switch and the motor to prevent movement of the second support relative to the first support when the lock-out switch is engaged. The lock-out switch enables the driver to prevent undesired or accidental movement of the control pedal.

From the foregoing disclosure and the following more detailed description of various preferred embodiments it will be apparent to those skilled in the art that the present invention provides a significant advance in the technology and art of control pedal assemblies. Particularly significant in this regard is the potential the invention affords for providing a high quality, feature-rich, low cost assembly. Additional features and advantages of various preferred embodiments will be better understood in view of the detailed description provided below.

BRIEF DESCRIPTION OF THE DRAWINGS

These and further features of the present invention will be apparent with reference to the following description and drawing, wherein:

FIG. 5A is an enlarged, fragmented perspective view of a portion of FIG. 3 showing a drive assembly of one of the control pedals of FIGS. 1–4, wherein the view is partially exploded and some components are removed for clarity;

FIG. 6 is an enlarged, fragmented elevational view, in cross section, of the drive assembly of FIG. 5A;

FIG. 8 is a control logic diagram for the control system of FIG. 6.

Figure 1:
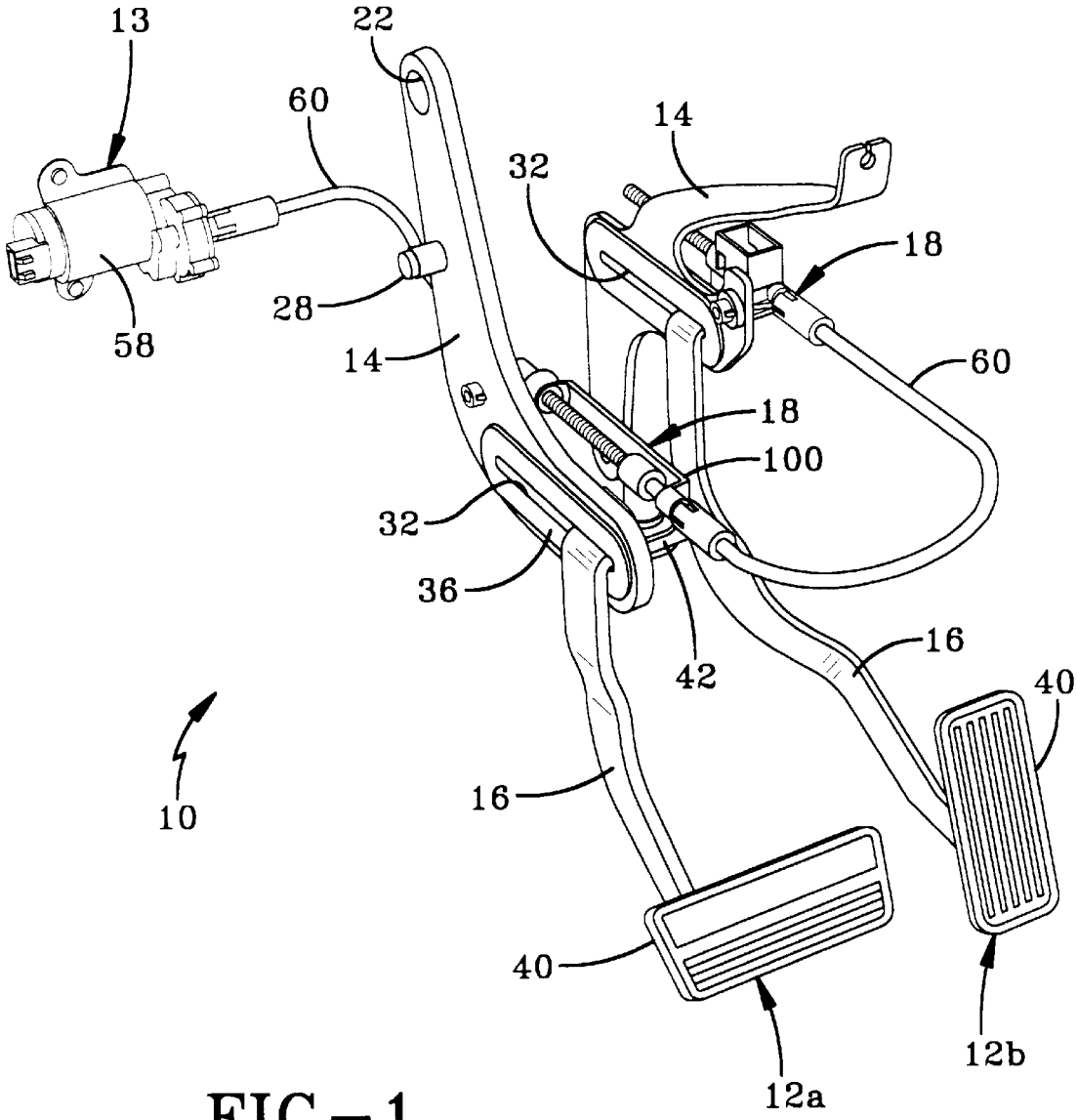
FIG. 1 is a perspective view of an adjustable control pedal assembly according to the present invention having two control pedals wherein each control pedal has a lower arm selectively movable relative to an upper arm along a horizontal slot provided in the upper arm.
Figure 2:
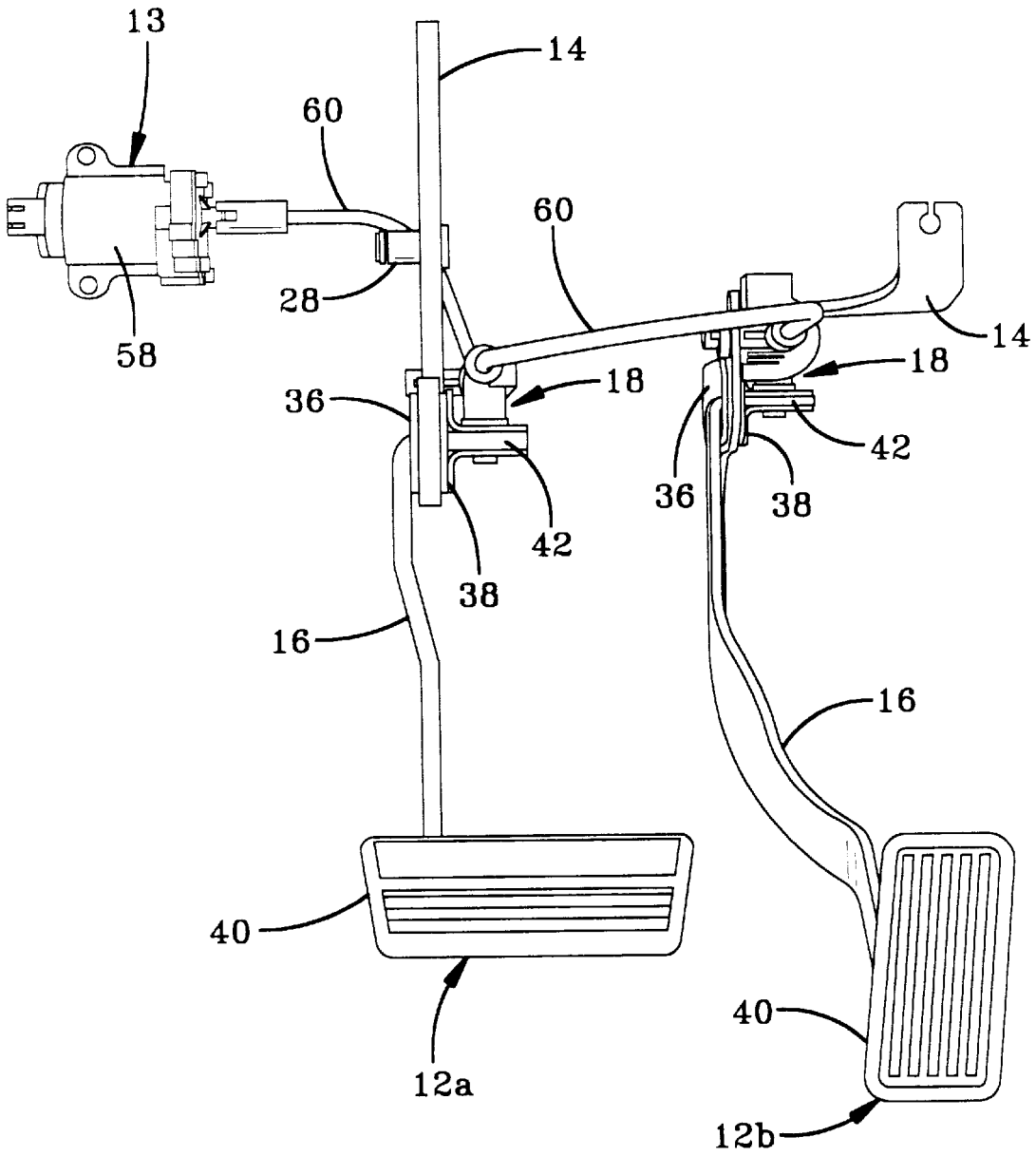
FIG. 2 is a rear elevational view of the adjustable control pedal assembly of FIG. 1.
Figure 3:
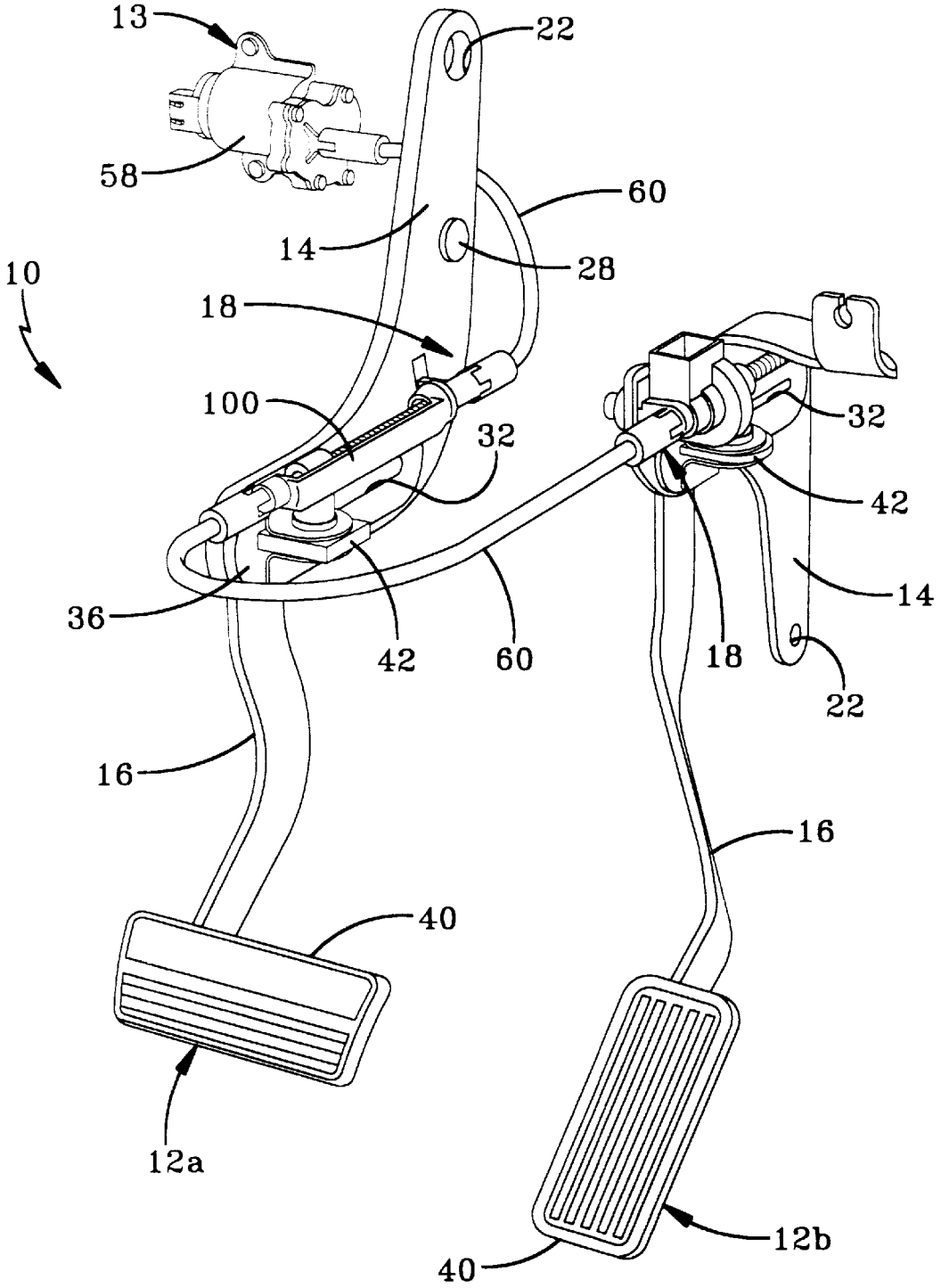
FIG. 3 is a perspective view of the adjustable control pedal assembly of FIGS. 1 and 2 showing the opposite side of FIG. 1.
Figure 4:
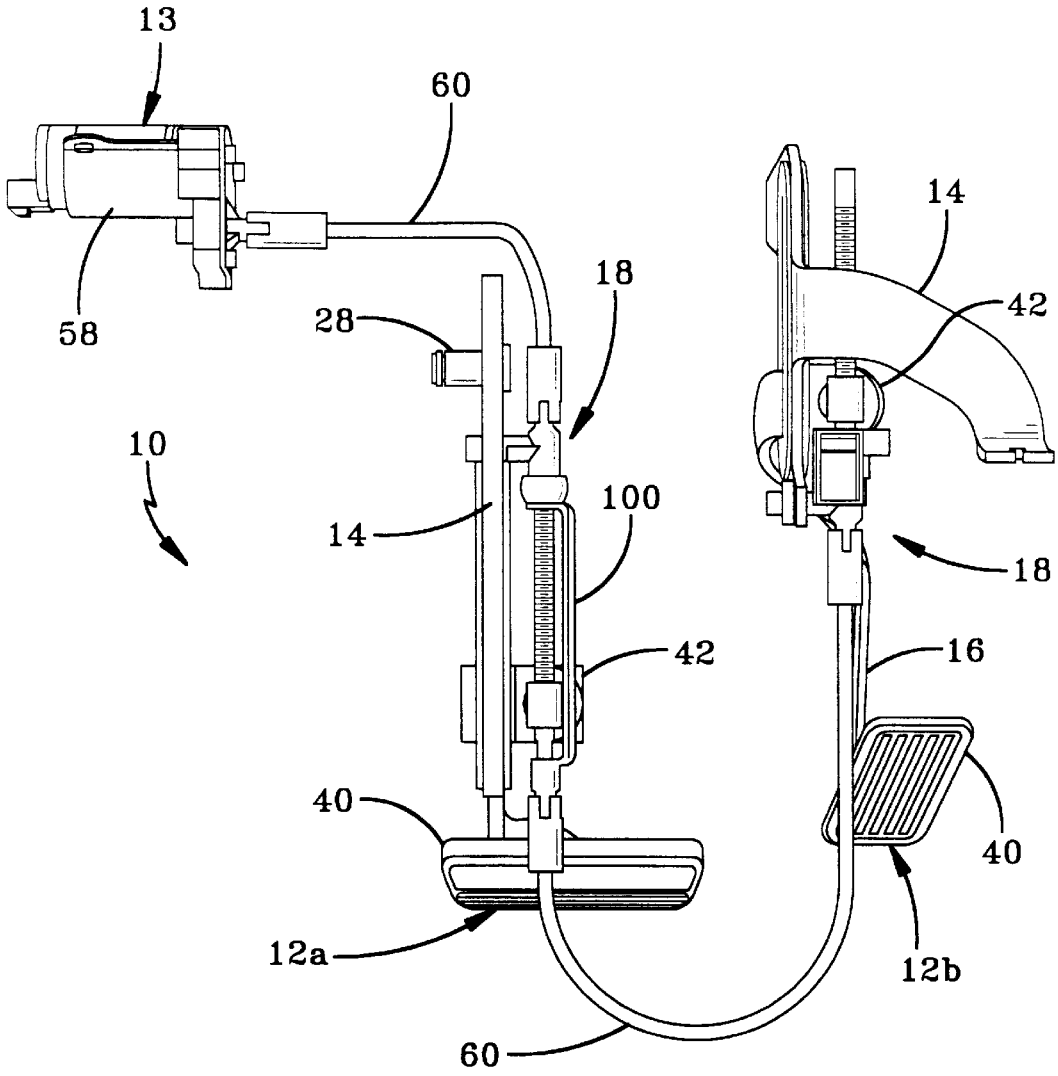
FIG. 4 is a top plan view of the adjustable control pedal assembly of FIGS. 1–3.

It should be understood that the appended drawings are not necessarily to scale, presenting a somewhat simplified representation of various preferred features illustrative of the basic principles of the invention. The specific design features of a control pedal assembly as disclosed herein, including, for example, specific dimensions of the upper and lower arms will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the control pedal assembly illustrated in the drawings. In general, up or upward refers to an upward direction in the plane of the paper in FIG. 1 and down or downward refers to a down direction in the plane of the paper in FIG. 1. Also in general, fore or forward refers to a direction toward the front of the motor vehicle and aft or rearward refers to a direction toward the rear of the motor vehicle.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved control pedal assemblies disclosed herein. The following detailed discussion of various alternative and preferred embodiments will illustrate the general principles of the invention with reference to a control pedal assembly for use with a motor vehicle. Other embodiments suitable for other applications will be apparent to those skilled in the art given the benefit of this disclosure. The term "snap-fit connection" is used herein and in the claims to mean a connection between at least two components wherein one of the components has an opening and the other component has a protrusion extending into the opening, and either the protrusion or the opening has a resiliently deformable to allow insertion of the protrusion into the opening as the deformable portion deforms upon entry but to deny undesired withdrawal of the protrusion from the opening after the deformable portion resiliently snaps back such that the two components are secured together.

Referring now to the drawings, FIGS. 1–6 show a control pedal assembly 10 for a motor vehicle, such as an automobile, according to the present invention which is selectively adjustable to a desired position by a driver. While the illustrated embodiments of the present invention are particularly adapted for use with an automobile, it is noted that the present invention can be utilized with any vehicle having at least one foot operated control pedal including trucks, buses, vans, recreational vehicles, earth moving equipment and the like, off road vehicles such as dune buggies and the like, air borne vehicles, and water borne vehicles.

The control pedal assembly 10 includes first and second control pedals 12*a,* 12*b* and a control system 13 for selectively adjusting the position of the control pedals 12*a,* 12*b*. In the illustrated embodiment, the control pedals 12*a,* 12*b* are adapted as brake and accelerator pedals respectively. While the illustrated control pedal assembly includes two control pedals 12*a*, 12*b*, it is noted that the control pedal assembly can have a single control pedal within the scope of the present invention such as, for example, a single pedal adapted as a clutch, brake or accelerator pedal. It is also noted that the control pedal assembly can have more than two control pedals within the scope of the present invention such as, for example, three pedals adapted as clutch, brake and accelerator pedals respectively.

The control pedals 12*a*, 12*b* are selectively adjustable by the operator in a forward/rearward direction. In multiple pedal embodiments, the control pedals 12*a*, 12*b* are preferably adjusted together simultaneously to maintain desired relationships between the pedals such as, for example, "step over", that is, the forward position of the accelerator pedal 12*b* relative to the brake pedal 12*a* (best shown in FIG. 4). It is noted however, that individual adjustment of each control pedal 12*a*, 12*b* is within the scope of the present invention.

Each pedal assembly is generally the same except as shown in FIGS. 1–6 and as noted herein below. Accordingly, only one control pedal 12*a* will be described in detail. The control pedal 12*a* includes an upper arm 14, a lower arm 16, and a drive assembly 18. The upper arm 14 is sized and shaped for pivotal attachment to a mounting bracket. The mounting bracket is adapted to rigidly attach the adjustable control pedal assembly 10 to a firewall or other rigid structure of the motor vehicle in a known manner. The upper arm 14 is generally an elongate plate oriented in a vertical plane. The illustrated upper arm 14 is generally "L-shaped" having an upper or vertical portion 14*a* which generally vertically extends downward from the mounting bracket and a lower or horizontal portion 14*b* which generally horizontally extends in a rearward direction from a lower end of the upper portion 14*a*.

The upper portion 14*a* of the upper arm 14 is adapted for pivotal attachment to the mounting bracket. The illustrated upper arm 14 has an opening 22 formed for cooperation with the mounting bracket and a pivot pin. With the pivot pin extending through the mounting bracket and the opening 22 of and the upper arm 14, the upper arm 14 is pivotable about a horizontally and laterally extending pivot axis 26 formed by the axis of the pivot pin. The upper arm 14 is operably connected to a control device such as a clutch, brake or throttle such that pivotal movement of the upper arm 14 operates the control device in a desired manner. The upper arm 14 can be connected to the control device by, for example, a push-pull cable for mechanical actuation or electrical wire or cable for electronic signals. The illustrated upper arm 14 is provided with a pin 28 for connection to the control device of a mechanical actuator.

The lower portion 14*b* of the upper arm 14 is adapted for supporting the lower arm 16 and for selected fore and aft movement of the lower arm 16 along the lower portion 14*b* of the upper arm 14. A horizontally extending slot 32 is formed in the lower portion 14*b* of the upper arm 14 and extends the entire thickness of the plate. The lower portion 14*b* is substantially planar or flat in the area of the slot. The slot 32 is adapted for cooperation with the lower arm 16 as described in more detail hereinbelow. The illustrated upper arm 14 includes an insert 34 forming the slot 32 but it is noted that the slot 32 can be formed solely by the plate of the upper arm 14. The insert 34 is formed of any suitable low friction and/or high wear resistant material such as, for example, an acetyl resin such as DELRIN. The insert 32 preferably extends along each side of the upper arm 14 around the entire periphery of the slot 32 to form planar laterally facing bearing surfaces 36, 38 adjacent the slot 32.

The lower arm 16 is sized and shaped for attachment to the upper arm 14 and selected fore and aft movement along the slot 32 of the upper arm 14. The lower arm 16 is generally an elongate plate oriented in a vertical plane so that it is generally a downward extension of the upper arm 14. The lower arm 16 includes a pedal 40 at its lower end and a guide 42 at its upper end. The pedal 40 is adapted for depression by the driver of the motor vehicle to pivot the lower and upper arms 14, 16 about the pivot axis 26 to obtain a desired control input to the motor vehicle. The guide 42 is sized and shaped for cooperation with the slot 32 of the upper arm 14. The illustrated guide 42 is a laterally and horizontally extending tab formed by bending the upper end of the lower arm 16 substantially perpendicular to the main body of the lower arm 16. The guide 42 and the slot 32 are preferably sized to minimize vertical movement of the guide 42 within the slot 32. It is noted that the guide 42 can take many alternative forms within the scope of the present invention. It is also noted that while the illustrated guide 42 is unitary with the main body of the lower arm 16, that is of one piece construction, the guide 42 can alternatively be integrally connected to the main body of the lower arm 16, that is a separate component rigidly secured to the main body of the lower arm 16.

The guide 42 extends through the slot 32 of the upper arm 14 so that the lower arm 16 is supported by the upper arm 14 by contact of the guide 42 and a bottom bearing surface of the slot 32 and the lower arm 16 is movable fore and aft relative to the upper arm 14 as the guide 42 slides along the bottom bearing surface of the slot 32. The main body of the lower arm 16 engages the bearing surface 36 adjacent the slot 32 on one side of the upper arm 14. Upper and lower bearing members 44, 46 are secured to the free end of the guide 42 on the opposite side of the upper arm 16 and engage the bearing surface 38 adjacent the slot 32 on the other side of the upper arm 14 above and below the slot 32 respectively. The upper and lower bearing members 44, 46 have a first portion for attachment to the guide 42 and a second portion forming a planar bearing surface 48 for engagement with the bearing surface 38 of the upper arm 14. The illustrated upper and lower bearing members 44, 46 are bent plates wherein the first portion is bent substantially perpendicular to the second portion. The lower arm 16 and the upper and lower bearing members 44, 46 are preferably sized to minimize lateral movement, or "side slash", of the guide 42. Assembled in this manner, the guide 42 is held in the slot 32 to secure the lower arm 16 to the upper arm 14 such that the lower arm guide 42 and lower arm 16 are only movable, relative to the upper arm 14, fore and aft along the slot 32.

As best shown in FIGS. 5 and 6, the drive assembly 18 includes a screw shaft or drive screw 50, a drive screw housing or attachment 52 for securing the drive assembly 18 to the upper arm 14, a drive nut 54 adapted for movement along the drive screw 50 in response to rotation of the drive screw 50, a drive nut mounting bracket or attachment 56 for securing the drive assembly 18 to the lower arm 16, an electric motor 58 for rotating the drive screw 50 (best shown in FIGS. 1–4), and a drive cable 60 for connecting the motor 58 to the drive screw 50 (best shown in FIGS. 1–4).

The drive screw 50 is an elongate shaft having a central threaded portion 62 adapted for cooperation with the drive nut 54. The drive screw 50 is preferably formed of resin such as, for example, NYLON but can be alternately formed of a metal such as, for example, steel. The forward end of the drive screw 50 is provided with a bearing surface 66 which cooperates with the drive screw attachment 52 to form a first self-aligning joint 68, that is, to freely permit pivoting of the drive screw 50 relative to the drive screw attachment 52 and the upper arm 14 about at least axes perpendicular to the drive screw rotational axis 64. The first self-aligning joint 68 automatically corrects misalignment of the drive screw 50 and/or the drive nut 54. The illustrated first self aligning joint 68 also forms a snap-fit connection between the drive screw 50 and the drive screw attachment 52. The illustrated bearing surface 66 is generally frusto-spherically shaped and unitary with the drive screw 50. It is noted that the bearing surfaces 66, and thus the first self-aligning joint 68, can have other forms within the scope of the present invention such as, for example, the embodiment shown in FIG. 8 and described in more detail hereinbelow.

Figure 5B:
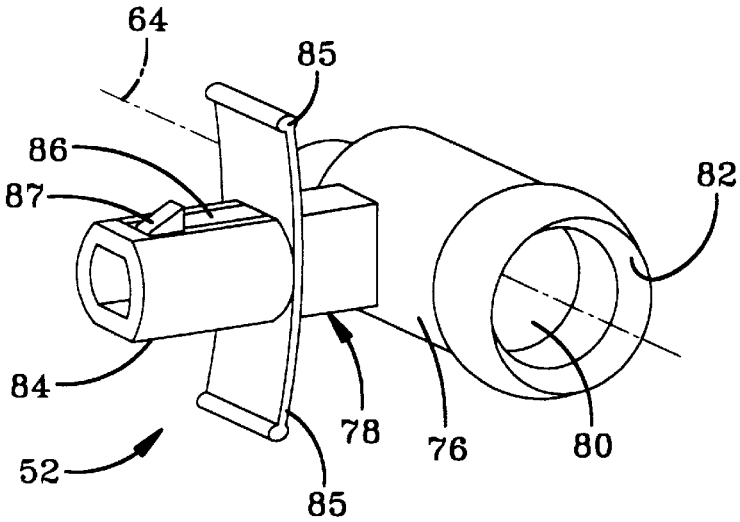
FIG. 5B is a perspective view of a drive screw attachment of the drive assembly of FIG. 5A.

As best shown in FIGS. 5B and 6, the drive screw attachment 52 is sized and shaped for supporting the drive screw 50 and attaching the drive screw 50 to the upper arm 14. The drive screw attachment 52 is preferably molded of a suitable plastic material such as, for example, NYLON but can alternatively be formed of metal such as steel. The drive screw attachment 52 includes a support portion 76 and an attachment portion 78. The support portion 76 is generally tubular-shaped having open ends. The rearward end of the support portion 76 forms a hollow portion or cavity 80 sized and shaped for cooperating the bearing surface 66 of the drive screw 50 to form the first self-aligning joint 68. The cavity 80 forms a bearing surface 82 sized and shaped to cooperate with the bearing surfaces 66 of the drive screw 50. The illustrated bearing surface 82 is a curved groove or race facing the rotational axis 64. The forward end of the support portion 76 is adapted for connection of the drive cable 60 in a known manner.

The attachment portion 78 of the drive screw attachment 52 is adapted for securing the support portion 76 to the upper arm 14. The illustrate attachment portion 78 is adapted as a "snap-in connection" having a tubular body 84 laterally extending from the support portion 76 main body, upper and lower tabs 85 extending from the body 84, and a pair of resiliently deformable fingers 86 carrying abutments 87. The body 84 is sized and shaped to extend through an opening formed in the upper arm 14 located generally above and forward of the slot 32. The tabs 85 are sized and shaped to engage the side of the upper arm 14 to limit insertion of the body 84 into the opening of the upper arm 14. The deformable fingers 86 are sized and shaped so that the fingers 86 are inwardly deflected into the hollow interior of the body 84 as the body 84 is inserted into the opening and resiliently return or spring back upon exiting the opening on the other side of the upper arm 14. Each deformable finger 86 is preferably provided with an angled camming surface to automatically deflect the finger 86 upon insertion of the body 84 into the opening of the upper arm 14. The abutments 87 formed by the fingers 86 are each sized and shaped to prevent undesired withdrawal of the body 84 from the opening of the upper arm 14 by creating an interference against withdrawal. To withdraw the body 84, the fingers 86 are depressed to inwardly move the abutments into the hollow interior of the body 84 and remove the interference.

As best shown in FIGS. 5A and 6, the drive nut 54 is adapted for movement along the drive screw 50 in response to rotation of the drive screw 50. The drive nut 54 is preferably molded of a suitable plastic material such as, for example, NYLON but can alternatively be formed of metal such as, for example steel. The illustrated drive nut 54 is generally "T-shaped" having a horizontally extending and tubular shaped top portion 88 and a vertically extending and tubular shaped bottom portion 89 downwardly extending from the center of the top portion 88. The top portion 88 has an opening extending therethrough which is provided with threads for cooperation with the drive screw 50. The threads can be unitary with the drive nut 54 or formed by an insert secured therein. The bottom portion 89 has a downward facing cavity forming a bearing surface 90 which is sized and shaped for cooperating with the drive nut attachment 56 to form a second self-aligning joint 92, that is, to freely permit pivoting of the drive nut 54 relative to the drive nut attachment 56 about at least axes perpendicular to the rotational axis 64. The illustrated second self-aligning joint 92 is a ball joint which permits pivoting of the drive nut 54 about every axis. The second self-aligning joint 92 automatically corrects misalignment of the drive nut 54 and/or drive screw 50. The illustrated second self aligning joint 92 also forms a snap-fit connection between the drive nut 54 and the drive nut attachment 56. The illustrated bearing surface 90 is generally frusto-spherically shaped. It is noted that the bearing surfaces 90, and thus the second self-aligning joint 92, can have other forms within the scope of the present invention.

The drive nut attachment 56 is sized and shaped for supporting the drive nut 54 and attaching the drive nut 54 to the lower arm 16. The drive nut attachment 56 is preferably molded of a suitable plastic material such as, for example, NYLON but can alternatively be formed of metal such as, for example, steel. The drive nut attachment 56 includes a support portion 93 and an attachment portion 94. The support portion 93 forms a bearing surface 96 for cooperation with the bearing surface 90 of the drive nut 54 as described above. The illustrated bearing surface 96 is a ball joint, that is, a generally frusto-spherically-shaped and is sized and shaped for receipt in the cavity of the drive nut 54 to engage the bearing surface 90 of the drive nut 54. The attachment portion 94 is adapted for securing the support portion 93 to the guide 42 of the lower arm 16. The illustrated attachment portion 96 is a generally cylindrically shaped protrusion which downwardly extends from the support portion 93. The attachment portion 94 is sized and shaped to extend through openings in the lower arm guide 42 and the upper and lower bearing members 44, 46. A collar 98 is preferably provided to limit downward passage of the protrusion 96 through the openings. The protrusion of the attachment portion 94 can be held in position by for example, a cotter pin, spring clip, snap-in fingers or members, or any other suitable method.

As best shown in FIGS. 1–4, the electric motor 58 can be of any suitable type and can be secured to the firewall or other suitable location such as, for example, the mounting bracket of the control pedal 12*a*. The drive cable 60 is preferably a flexible cable and connects the motor 58 and the drive screw 50 so that rotation of the motor 58 rotates the drive screw 50. It is noted that the drive screw 50 and the motor can be alternatively connected with a rigid connection. An input end of the drive cable 60 is connected to an output shaft of the motor 58 and an output end of the drive cable 60 is connected to the end of the drive screw 50. It is noted that suitable gearing is provided between the motor 58 and the drive screw 50 as necessary depending on the requirements of the assembly 10. It is also noted that the fixed portion or sheath of the drive cable 60 is rigidly secured to the forward end of the drive screw attachment 52 and a rotating portion or cable is operatively connected to the forward end of the drive screw 50 to rotate the drive screw 50 therewith.

As best shown in FIGS. 1–6, the illustrated drive assembly 18 also includes a cable support 100 for connecting the drive cable of the 60 of the second control pedal 12*b* to the rearward end of the drive screw 50. Connecting or chaining the drive screws 50 with the electric motor 58 in series enables a single motor 58 to be utilized to adjust multiple control pedals 12*a*, 12*b*. It should be noted that additional control pedals 12*a*, 12*b* can be connected in this manner. It is also noted that if the control pedal assembly 10 has a single control pedal 12*a*, the drive screw 50 is the final control pedal 12*b* of the drive chain, or each control pedal 12*a*, 12*b* is driven by a separate motor 58, the cable support 100 is not necessary.

As best shown in FIGS. 5A and 6, the cable support 100 has a attachment portion 102, a support portion 104, and a connecting portion 106. The attachment portion 102 is generally tubular shaped and adapted to form a "snap fit connection" with the drive screw attachment 52. The illustrated attachment portion is sized and shaped to snap over the rearward end of the drive screw attachment 52 at the first self-aligning joint 68. The support portion 104 is generally tubular shaped and adapted to support the drive cable 60 at the rearward end of the drive screw 50. The connecting portion 106 is sized and shaped to connect the attachment portion 102 and the support portion 104 such that the support portion 104 is supported by the attachment portion 102 in a cantilevered manner. The illustrated connecting portion 106 extends along the drive screw 50 at the lateral side opposite the upper arm to act as a shield or cover for the drive screw 50. Configured in this manner, the drive cable 60 is supported without additional attachment to the upper arm 14.

Figure 7:
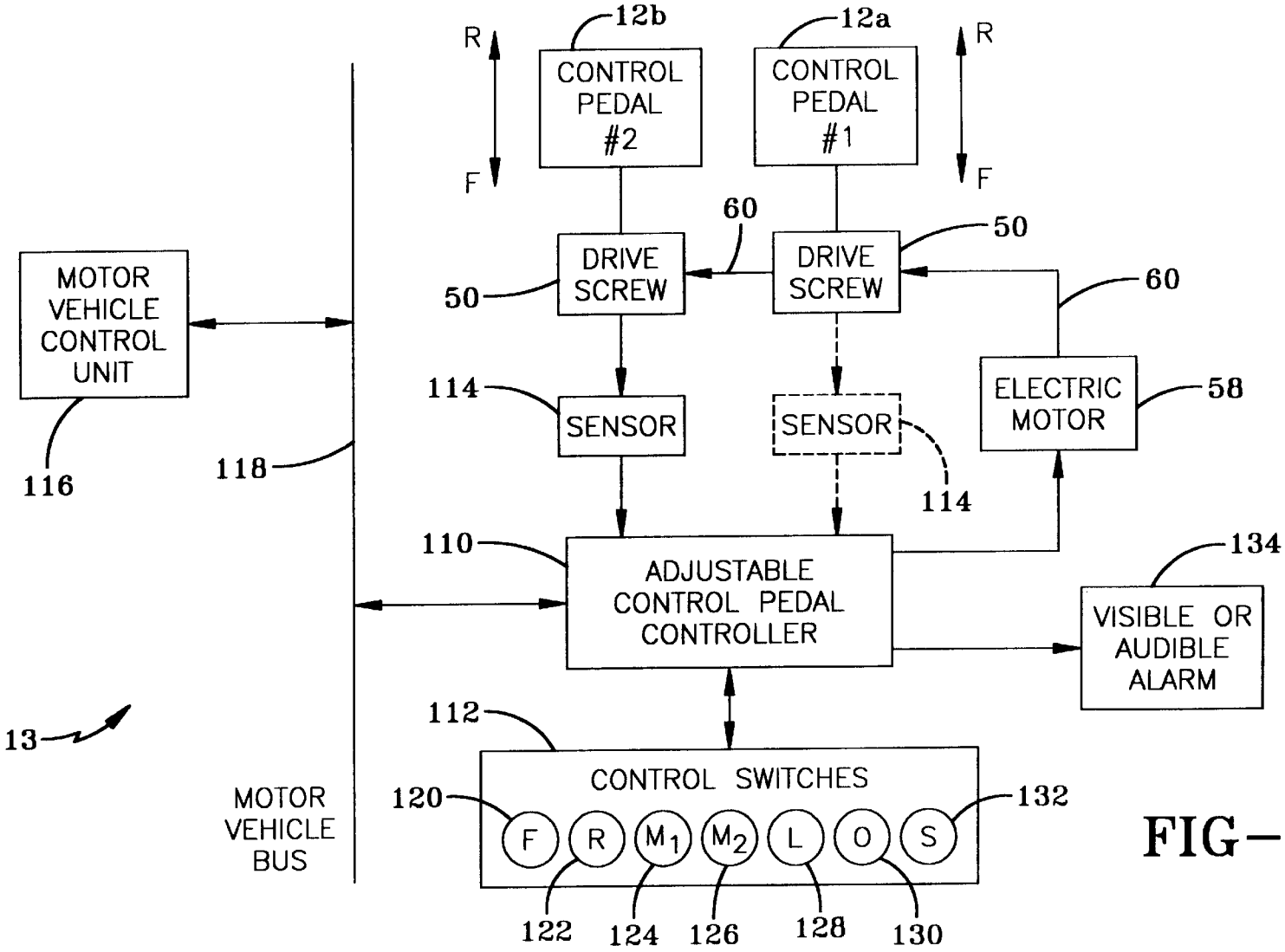
FIG. 7 is a schematic view of a control system for the adjustable control pedal assembly of FIGS. 1–6.

As best shown in FIG. 7, the control system 13 preferably includes a central processing unit (CPU) or controller 110 for activating the motor 58, control switches 112 for inputting information from the driver to the controller 110, and at least one sensor 114 for detecting motion of the control pedals 12*a*, 12*b* such as rotation of the drive screws 50. The control system 13 forms a control loop wherein the controller 110 selectively sends signals to the motor 58 to activate and deactivate the motor 58. When activated, the motor 58 rotates the drive screws 50 through the drive cables 60. The sensor or sensors 14 detect movement of the control pedals 12*a*, 12*b*, such as rotations of the drive screws 50, and sends signals to the controller 110.

The controller 110 includes processing means and memory means which are adapted to control operation of the adjustable control pedal assembly 10. The controller 110 is preferably in communication with a motor vehicle control unit 116 through a local bus 118 of the motor vehicle so that motor vehicle information can be supplied to or examined by the controller 110 and status of the control pedal assembly 10 can be supplied to or examined by the motor vehicle control unit 116. It is noted that while the control system 13 of the illustrated embodiment utilizes a dedicated controller 110, the controller 110 can alternatively be the motor vehicle control unit 116 or can be a controller of another system of the motor vehicle such as, for example, a keyless entry system or a powered seat system.

The control switches 112 are preferably push-button type switches but alternatively can be in many other forms such as, for example, toggle switches. The control switches 112 include at least a forward switch 120 which when activated sends control signals to move the control pedal 40 in a forward direction and a reverse or rearward switch 122 which when activated sends control signals to move the control pedal 40 in a rearward direction. Preferably, the control switches 112 include memory switches 124, 126 which when activated return the control pedal 40 to preferred locations previously saved in memory of the controller 110, a lock out switch 128 which when activated sends control signals preventing movement of the control pedal 40, an override switch 130 which when activated permits the control pedal 40 to be moved by the driver in a desired manner regardless of existing conditions, and a memory save switch 132 which when activated sends a signal to save the current position of the control pedal 40 in memory of the controller 110.

The sensor 114 is adapted to detect movement of the control pedal assembly 10 and send signals relating to such movement to the controller 110. The sensor 114 is preferably located adjacent the drive screw 50 and adapted to detect rotations of the drive screw 50. It is noted, however, that other sensors for detecting motion would be readily apparent to those skilled in the art such as, for example, a sensor for detecting rotational movement between upper and lower arms. The sensor 114 is preferably a Hall effect device mounted adjacent the drive screw 50 to directly sense each rotation of the drive screw 50 and to send a pulse or signal to the controller 110 for each revolution of the drive screw. Note that the pulses or signals can alternatively be for a portion of a rotation or for more than one rotation. The sensor 114 can alternately be another suitable non-contact sensor such as, for example, an inductance sensor, a potentiometer, an encoder, or the like. This rotational information obtained by sensor 114 is utilized by the controller 110 in many ways such as described hereinbelow.

The rotational information can be utilized to detect a failure in the control pedal assembly 10. A failure in the control pedal assembly 10 is detected if signals (or lack thereof) from the sensor 114 to the controller 110 indicate that the drive screw 50 is not rotating, after the controller 110 has sent signals to activate the motor 58. If the sensor 114 detects a control pedal assembly failure, the control pedal assembly 10 is preferably "shut down" to prevent any further activation of the motor 58 and possible damage to the control pedal assembly 10. By directly sensing rotation of the drive screw 50 rather than at an intermediate point such as, for example, the shaft of the motor 58, failure of any component of the control pedal assembly 10 is detected. Failures which are detected include failure of the motor 58, failure of the sensor 104, failure of the drive assembly 18, and failure of the drive cable 60. A visible warning instrument or audible alarm 134, such as the illustrated LCD, is preferably provided so that a failure condition can be indicated to the driver.

The rotational information can additionally be utilized to automatically stop the drive nut 54 at ends of travel along the drive screw 50. The controller 110 is adapted to stop the motor 58 when the rotational information indicates that the drive nut 54 has reached a predetermined end of travel along the drive screw 50. The stop points are preprogrammed in the controller 110. When the controller 110 receives signals from the sensor 104 indicating that the drive nut 54 has reached the predetermined stop points, the controller 110 stops the motor 58 and thus the movement of the drive nut 54 along the drive screw 50. For example, the total travel of the pedal assembly 110 is defined by a predetermined number of sensor pulses and the controller 110 sends a stop signal to the motor 58 just prior to the pedal assembly 10 reaching the saved pulse number indicating a desired end of travel so that the pedal assembly 10 stops at the desired end of travel. Fore-aft movement of the lower arm 16, therefore, is electronically stopped without engaging mechanical stops and resulting stress on the motor 58 and mechanical components. When a "hard stop" is engaged, the motor 58 stalls and current increases which may cause overheating of the motor 58 and a resulting shortened life of the motor 58. It is noted, however, that the pedal assembly 10 is preferably provided with mechanical or "hard" stops for limiting travel of the drive nut 54 just beyond the "soft stops" for use in the event of a failure of the electronic or "soft" stops. In the illustrated embodiment, the hard stops include the ends of the slot 32 which form abutments which are engaged by the guide 42 at the end of travel along the slot to limit fore-aft movement of the lower arm 16 and axial movement of the drive nut 54.

The rotational information can be further utilized to return the control pedal assembly 10 to a stored preferred location when selected by the driver. The driver adjusts the pedal assembly 10 to a preferred location and engages the memory save switch 132 so that the rotational information indicating the position of the drive nut 54 in the preferred location is saved in memory. At a later time, when the driver engages a memory switch 124, 126, the controller 110 automatically starts the motor 58 to rotate the drive screw 50 and move the drive nut 54 toward the saved position of the drive nut 54. The controller 110 automatically stops the motor 58 when the rotational information (pulse count) from the sensor 114 indicates that the drive nut 54 has reached the saved position (saved pulse count) along the drive screw 50.

The controller 110 is preferably adapted so that the pedal assembly 10 automatically moves forward to a predetermined location such as, for example, a full forward position under predetermined conditions. The predetermined conditions for moving the pedal assembly 10 forward are preferably the ignition key off and/or the door open. The pedal assembly 10 is then returned to the previous position or a memorized position once other predetermined conditions are met. The predetermined conditions for moving the pedal assembly 10 back to the previous position are preferably the ignition key on and/or the door closed. By moving the pedal assembly 10 to a forward position, the driver is able to more easily egress and/or ingress the motor vehicle.

The controller 110 is also preferably adapted so that the pedal assembly 10 cannot be adjusted under predetermined conditions. That is, the adjustment feature of the pedal assembly 10 is "locked-out" under certain conditions. The predetermined conditions which lock-out the pedal assembly 10 are preferably ignition key on, motor vehicle speed exceeds a predetermined speed, door is open, trunk is open, and/or driver's seat belt not fastened. Preferably, the driver can override the lock-out by engaging the override switch 130 and/or manually engage the lock-out when desired by engaging the lock out switch 128.

Each control pedal 12*a*, 12*b* preferably includes a separate sensor 114 at the drive screw 50 so that rotation information is obtained regarding each of the drive screws 50. By having rotation information regarding each drive screw 50, the controller 110 can identify when the control pedals 12*a*, 12*b*, are not moving in the same manner. Preferably, the controller 110 sends a signal to stop the motor 58 if there is an indication that a predetermined relationship between two or more of the control pedals 12*a*, 12*b* is not maintained. For example, the predetermined relationship can be the step over of the brake and accelerator pedals. It is noted that alternatively, a single sensor 114 can be utilized which is located at the drive screw 50 at the end of the drive chain and/or separate motors 58 can be used for each of the control pedals 12*a*, 12*b*. It is also noted that while brake pedal is at the beginning of the chain and the accelerator pedal is at the end of the chain in the illustrated embodiment, the control pedals 12*a*, 12*b* can be connected in other arrangements.

FIG. 8 illustrates a control logic diagram of a preferred control system 13 using finite-state-machine theory. The states of the control pedal assembly 10 are stop, stall or motor failure, step over, sensor or drive mechanism failure, forward, reverse (rearward), memory 1, and memory 2. Each state can be defined in terms of the sensor output or the controller output to the motor (pedal positions and motor torque). At the stop state, $T_e=0$ or $<T_{min}$ where $T_e$ is the motor output torque and $T_{min}$ is the minimum torque required to move the motor. At the stall or motor failure state, the condition is either $T_c\neq 0$ and the event set is $[T_e=0$ and $\Delta C_i=0]$ where $T_c$ is the controller output signal to the motor which may be positive or negative, $\Delta C_i$ represents an increment of pulse or the condition is $T_c\neq 0$ and the event set is $[\Delta C_i=0, i=1,2,3]$ where $C_i$ (i=1,2,3) is the pulse counting of each pedal. At the step over, sensor, or drive mechanism (including the drive screw) failure state, the condition is $T_c\neq 0$ and $T_e\neq 0$ and the condition set is either $[\Delta C_i=0, \Delta C_j\neq 0, (i\neq j)]$ or $|C_i-C_j|>C_{limit}(i\neq j, i,j=1,2,3)]$ where $C_{limit}$ denotes a certain pulse limit, exceeding which a step over failure occurs. At the forward state, $T_e>0$. At the reverse state $T_e<0$. At the memory 1 state, $T_e=0$, $C_i=C_{mem1}$,(i=1,2,3) where $C_{mem1}$ is the first memorized pulse count. At the memory 2 state, $T_e=0$, $C_i=C_{mem2}$, (i=1,2,3) where $C_{mem2}$ is the second memorized pulse count. The switch signals are denoted as follows: F=1 indicates the forward switch is pushed or engaged; R=1 indicates the reverse switch is engaged or activated; M=1 indicates that the memory 1 switch is pushed or engaged; M=2 indicates that the memory 2 switch is pushed or engaged; L=1 indicates that the lock out switch is pushed or engaged; O=1 indicates that the override switch is pushed or engaged; I=1 indicates that the ignition key is on (this may also include or be replaced by D=1 which indicates the door is open); S=1 indicates save pulse count to memory; and FL=1 indicates the fault light or alarm is activated.

When the ignition key is on (I=1), the control pedals 12*a*, 12*b* automatically move to the previous memorized position and are ready to move. If the lock out feature is on (L=1), however, the control pedals 12*a*, 12*b* will remain in the present position and are unable to move until or unless the override switch 130 is engaged (O=1). Within the operation loop, there are three levels: a memory level wherein the control pedals 12*a*, 12*b* move to predefined positions stored in memory and stop; a moving level wherein the motor 58 will move the control pedals 12*a*, 12*b* forward and rearward depending of input signals from the switches 112; and a fault or failure level wherein the system has problems and the alarm 134 is activated. In the move level, the driver can adjust the control pedals 12*a*, 12*b* forward or rearward, by engaging the forward and rearward switches (F=1, R=1)120, 122 respectively, until the control pedals 12*a*, 12*b* reach a desired position. The position of the control pedals 12*a*, 12*b*, that is the pulse count, is saved in memory if the save switch 132 is activated (s=1) or some predetermined conditions are satisfied such as, for example, one of the memory switches 124, 126 are activated (M=1 or M=2) and no further movement occurs in a certain period of time. If a fault or failure is detected, the control pedals 12*a*, 12*b* are immediately stopped at the present position and the alarm 134 is activated (FL=1).

The electronic or "soft" stops can be implemented by establishing the number of pulses received from the sensor 114 over the desired stroke of the control pedals 12*a*, 12*b* (a total pulse count). Upper and lower pulse count limits ($C_{upper\text{-}limit}$ and $C_{lower\text{-}limit}$) are established where the control pedal 12*a*, 12*b* can be stopped prior to engaging the mechanical or "hard" stops. For example, if the total pulse count is 130 where 130 is the far forward position and 0 is the far rearward position, the control pedal 12*a*, 12*b* can be operated between lower and upper pulse limits of about 5 and about 125 respectively.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the control pedal assembly can at least partly be operated from a remote control unit such as a keyless entry device. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A method of operating a control pedal assembly comprising the steps of, in combination:

providing a pair of adjustable control pedals, each of the pair of the control pedals including a first support and a second support, the second support being moveable relative to the first support to adjust the fore-aft position of the second support upon operation of a motor;

providing a predetermined fore-aft relationship between the second support of a first one of the pair of control pedals and the second support of a second one of the pair of control pedals;

maintaining the predetermined fore-aft relationship during operation of the motor to move the second support of the first one of the pair of control pedals and the second support of the second one of the pair of control pedals while adjusting the fore-aft position of the lower arm of the first control pedal and the lower arm of the second control pedal;

stopping the motor during operation if the predetermined fore-aft relationship is not maintained; and determining the movement of at least one of the second supports relative to at least one of the first supports.

2. A method of operating a control pedal assembly comprising the steps of, in combination:

providing a pair of adjustable control pedals, each of the pair of the control pedals including a first support and a second support, the second support being moveable relative to the first support to adjust the fore-aft position of the second support upon operation of a motor;

providing a predetermined fore-aft relationship between the second support of a first one of the pair of control pedals and the second support of a second one of the pair of control pedals;

maintaining the predetermined fore-aft relationship during operation of the motor to move the second support of the first one of the pair of control pedals and the second support of the second one of the pair of control pedals while adjusting the fore-aft position of the lower arm of the first control pedal and the lower arm of the second control pedal;

stopping the motor during operation if the predetermined fore-aft relationship is not maintained; and moving each of the second supports to a forward position in response to a control signal.

3. The method as claimed in claim 2, wherein the control signal is one of a vehicle ignition switch, vehicle open door, vehicle trunk lid open, a manual switch and a memory device.

4. A method of operating a control pedal assembly comprising the steps of, in combination:

providing a pair of adjustable control pedals, each of the pair of the control pedals including a first support and a second support, the second support being moveable relative to the first support to adjust the fore-aft position of the second support upon operation of a motor;

providing a predetermined fore-aft relationship between the second support of a first one of the pair of control pedals and the second support of a second one of the pair of control pedals;

maintaining the predetermined fore-aft relationship during operation of the motor to move the second support of the first one of the pair of control pedals and the second support of the second one of the pair of control pedals while adjusting the fore-aft position of the lower arm of the first control pedal and the lower arm of the second control pedal;

stopping the motor during operation if the predetermined fore-aft relationship is not maintained; and preventing movement of one of the second supports relative to one of the first supports when a control device is engaged and allowing movement of one of the second supports relative to one of the first supports when the control device is disengaged.

5. A method of operating a control pedal assembly comprising the steps of, in combination:

providing a pair of adjustable control pedals, each of the pair of the control petals including a first support and a second support, the second support being moveable relative to the first support to adjust the fore-aft position of the second support upon operation of a motor;

providing a predetermined fore-aft relationship between the second support of a first one of the pair of control pedals and the second support of a second one of the pair of control pedals;

maintaining the predetermined fore-aft relationship during operation of the motor to move the second support of the first one of the pair of control pedals and the second support of the second one of the pair of control pedals while adjusting the fore-aft position of the lower arm of the first control pedal and the lower arm of the second control pedal;

stopping the motor during operation if the predetermined fore-aft relationship is not maintained; and providing at least one sensor at least partially supported by one of the first support and the second support and determining the position of one of the second supports relative to one of the first supports with the sensor in order to identify whether the predetermined fore-aft relationship has been maintained.

6. The method as claimed in claim 1, further comprising the step of detecting movement with a non-contact sensor.

7. The method as claimed in claim 6, wherein the step of detecting movement with a non-contact sensor comprises detecting movement with at least one of a Hall effect device, an inductance sensor, a potentiometer, and an encoder.

8. The method as claimed in claim 1, further comprising the step of detecting movement with means for measuring rotational movement.

9. The method as claimed in claim 1, wherein the step of determining the movement of at least one of the second supports relative to at least one of the first supports comprises determining the movement of each of the second supports.

10. A method of operating a control pedal assembly comprising the steps of, in combination:

providing a first adjustable control pedal including a first upper support and a first lower support, the first lower support being moveable relative to the first upper support to adjust the fore-aft position of the first lower support;

providing a second adjustable control pedal including a second upper support and a second lower support, the second lower support being moveable relative to the second upper support to adjust the fore-aft position of the first lower support;

providing a predetermined fore-aft relationship between the first lower support and the second lower support;

simultaneously moving the first lower support relative to the first upper support and the second lower support relative to the second upper support to adjust the fore-aft position of the first and second lower supports while attempting to maintain the predetermined fore-aft relationship; and identifying when the predetermined fore-aft relationship is not maintained.

11. The method as claimed in claim 10, further comprising the step of determining the movement of at least one of the first and second lower supports.

12. The method as claimed in claim 11, wherein the step of determining the movement of at least one of the first and second lower supports comprises determining the movement of each of the first and second lower supports.

13. The method as claimed in claim 10, further comprising the step of stopping movement of the first and second lower supports when the predetermined fore-aft relationship is not maintained.

14. The method as claimed in claim 10, further comprising the step of providing a controller operably connected to each of the first and second control pedals and determining with the controller a fore-aft position of each of the first and second lower supports.

15. The method as claimed in claim 10, further comprising the step of detecting movement with a non-contact sensor.

16. The method as claimed in claim 15, wherein the step of detecting movement with a non-contact sensor comprises detecting movement with at least one of a Hall effect device, an inductance sensor, a potentiometer, and an encoder.

17. The method as claimed in claim 10, further comprising the stop of detecting movement with means for measuring rotational movement.

18. A method of operating a control pedal assembly comprising the steps of, in combination:

providing a first adjustable control pedal including a first upper support and a first lower support, the first lower support being moveable relative to the first upper support to adjust the fore-aft position of the first lower support;

providing a second adjustable control pedal including a second upper support and a second lower support, the second lower support being moveable relative to the second upper support to adjust the fore-aft position of the first lower support;

providing a predetermined fore-aft relationship between the first lower support and the second lower support;

providing a controller operably connected to each of the first and second control pedals;

simultaneously moving the first lower support relative to the first upper support and the second lower support relative to the second upper support to adjust the fore-aft position of the first and second lower supports;

providing a signal to the controller indicative of movement of the first lower support;

providing a signal to the controller indicative of movement of the second lower support; and determining with the controller whether the predetermined fore-aft relationship is not maintained.

19. The method as claimed in claim 18, further comprising the step of determining with the controller a fore-aft position of each of the first and second lower supports.

20. The method as claimed in claim 18, further comprising the step of stopping movement of the first and second lower supports when the controller determines that the predetermined fore-aft relationship is not maintained.

21. The method as claimed in claim 18, further comprising the step of detecting movement with a non-contact sensor.

22. The method as claimed in claim 21, wherein the step of detecting movement with a non-contact sensor comprises detecting movement with at least one of a Hall effect device, an inductance sensor, a potentiometer, and an encoder.

23. The method as claimed in claim 18, further comprising the step of detecting movement with means for measuring rotational movement.

* * * * *